US008403817B2

(12) United States Patent
Ferguson et al.

(10) Patent No.: US 8,403,817 B2
(45) Date of Patent: Mar. 26, 2013

(54) PORTABLE FOOT AND ANKLE EXERCISE APPARATUS AND ASSOCIATED METHODS

(75) Inventors: Matthew Earle Crozier Ferguson, Port Moody (CA); Richard Stephen Hall, Port Moody (CA); Jordan Aldon Myers, Coquitlam (CA); Scott Howard Phillips, Victoria (CA); Christopher Grant Denny, Victoria (CA)

(73) Assignee: Progressive Health Innovations Incorporated, Port Moody (CA)

( * ) Notice: Subject to any disclaimer, the term of this patent is extended or adjusted under 35 U.S.C. 154(b) by 600 days.

(21) Appl. No.: 12/663,214

(22) PCT Filed: Jun. 4, 2008

(86) PCT No.: PCT/CA2008/001061

§ 371 (c)(1),
(2), (4) Date: May 28, 2010

(87) PCT Pub. No.: WO2008/148192

PCT Pub. Date: Dec. 11, 2008

(65) Prior Publication Data

US 2010/0261583 A1 Oct. 14, 2010

Related U.S. Application Data

(60) Provisional application No. 60/941,945, filed on Jun. 4, 2007.

(51) Int. Cl.
*A63B 21/00* (2006.01)

(52) U.S. Cl. ..... 482/79; 482/74

(58) Field of Classification Search ..... 482/74, 482/79, 80, 44, 100, 137, 10
See application file for complete search history.

(56) References Cited

U.S. PATENT DOCUMENTS

| | | | |
|---|---|---|---|
| 539,872 | A | 5/1895 | Kheiralla |
| 1,671,096 | A | 5/1928 | Anderson |
| 1,952,750 | A | 3/1934 | Gailey |
| 2,097,376 | A | 10/1937 | Marshman |
| 2,160,722 | A | 5/1939 | Cunningham |
| 2,206,902 | A | 7/1940 | Kost |
| 3,295,847 | A | 1/1967 | Matt, Sr. |
| 3,421,760 | A | 1/1969 | Freeman, Jr. |
| 3,984,100 | A | 10/1976 | Firster |
| 4,186,920 | A | 2/1980 | Fiore et al. |
| 4,251,070 | A | 2/1981 | Leseberg |
| 4,306,714 | A | 12/1981 | Loomis et al. |
| 4,310,155 | A | 1/1982 | White |
| 4,337,939 | A | 7/1982 | Hoyle et al. |
| 4,371,161 | A | 2/1983 | Williams |
| 4,452,447 | A | 6/1984 | Lepley et al. |
| 4,461,472 | A | 7/1984 | Martinez |
| 4,478,414 | A | 10/1984 | Molloy |
| 4,600,188 | A | 7/1986 | Bangerter et al. |
| 4,605,220 | A | 8/1986 | Troxel |
| 4,650,183 | A | 3/1987 | McIntyre |
| 4,728,103 | A | 3/1988 | Fulton |
| 4,739,986 | A | 4/1988 | Kucharik et al. |
| 4,767,118 | A | 8/1988 | Ostergard |

(Continued)

FOREIGN PATENT DOCUMENTS

| | | | |
|---|---|---|---|
| CA | 2600205 | A1 | 9/2006 |

*Primary Examiner* — Jerome W Donnelly
(74) *Attorney, Agent, or Firm* — Oyen Wiggs Green & Mutala LLP

(57) ABSTRACT

A foot, toe, and ankle exercise device provides variable resistance to movements of the foot, ankle and toes in multiple directions. Embodiments of the device comprise a flexible forefoot support to allow for full toe and foot range of motion. Resistance is provided by resistance members that may comprise elastic banding or tubing. The forefoot support may be suspended by the resistance members.

22 Claims, 15 Drawing Sheets

U.S. PATENT DOCUMENTS

| | | | |
|---|---|---|---|
| 4,979,737 | A | 12/1990 | Kock |
| 4,998,722 | A | 3/1991 | Scott |
| 5,004,228 | A | 4/1991 | Powers |
| 5,039,093 | A | 8/1991 | Collier |
| 5,100,129 | A | 3/1992 | Porter et al. |
| 5,178,596 | A | 1/1993 | McIntire |
| 5,186,698 | A | 2/1993 | Mason et al. |
| 5,215,508 | A | 6/1993 | Bastow |
| 5,277,680 | A | 1/1994 | Johnston |
| 5,368,536 | A | 11/1994 | Stodgell |
| 5,413,543 | A | 5/1995 | Drago |
| 5,582,579 | A | 12/1996 | Chism et al. |
| 5,618,247 | A | 4/1997 | Perez |
| 5,645,516 | A | 7/1997 | Foster |
| 5,749,668 | A | 5/1998 | McIlvain et al. |
| 5,860,423 | A | 1/1999 | Thompson |
| 5,897,464 | A | 4/1999 | Mcleod |
| 6,063,010 | A | 5/2000 | Howd et al. |
| 6,063,013 | A | 5/2000 | Vathappallil |
| 6,109,990 | A | 8/2000 | Lundberg |
| 6,110,078 | A | 8/2000 | Dyer |
| 6,312,361 | B1 | 11/2001 | Hayes |
| 6,390,957 | B1 | 5/2002 | Knight |
| 6,540,651 | B1 | 4/2003 | Aberton et al. |
| 6,811,523 | B1 | 11/2004 | Timmer |
| 6,821,235 | B1 | 11/2004 | Johnson et al. |
| 6,878,102 | B1 | 4/2005 | Commisso |
| 2002/0137608 | A1 | 9/2002 | Knight |
| 2005/0043150 | A1 | 2/2005 | Nitta et al. |
| 2005/0209067 | A1 | 9/2005 | Backes et al. |
| 2007/0287615 | A1 | 12/2007 | Gilchrist |

PORTABLE FOOT AND ANKLE EXERCISE APPARATUS AND ASSOCIATED METHODS

CROSS-REFERENCE TO RELATED APPLICATIONS

This application claims priority from U.S. application Ser. No. 60/941,945 filed 4 Jun. 2007. For purposes of the United States of America, this application claims the benefit under 35 U.S.C. §119 of U.S. application No. 60/941,945 and is a continuation-in-part of U.S. application Ser. No. 11/908,122 filed 8 Mar. 2006, both of which are hereby incorporated herein by reference.

TECHNICAL FIELD

This invention relates to exercise apparatus and, more specifically, to apparatus for exercising muscles, tendons, ligaments and/or other tissues related to the foot, toes, and/or ankle.

BACKGROUND

The foot and ankle are often overlooked in exercise programs, yet feet and ankles are extremely important areas of the body. Unfortunately, injuries to the foot or ankle are common in a variety of sports, work activities, or activities of daily living. Many treatment methods are available to deal with foot and ankle injuries (chiropractic adjustments, inflammation-reduction treatments such as ultrasound or microcurrent, range of motion exercises, coordination and balance exercises such as wobble board, strengthening exercises using resistive strength equipment, orthotics, etc.). However, none of the treatments or devices commonly utilized in the health care and exercise fields offers a complete range of exercises to properly strengthen the foot and ankle in isolation or in a combination of movements (e.g. functional movements). Also, existing foot exercising devices do not easily allow a patient to perform passive (i.e. with muscles relaxed) range of motion exercises. Passive exercises can be beneficial during early-stage rehabilitation. Furthermore, existing devices do not easily allow for eccentric loading of the musculature of the foot and ankle in a non-weight-bearing manner. Eccentric loading has been shown to be very effective in rehabilitating chronic tendonitis. Eccentric loading involves allowing a muscle to elongate while the muscle is under tension.

Balanced strengthening of the foot and ankle requires resistance exercises in multiple directions. Performing calf raises using body weight as resistance or with strength training equipment will strengthen the foot and ankle in plantar flexion; however, this results in unidirectional strengthening only. Various health practitioners recommend that patients grasp towels with their toes to strengthen the plantar musculature of the foot. Although this provides some resistance, it is cumbersome and there is limited opportunity to increase or monitor the resistance. Progressive increases in resistance are important to allow for strengthening of the associated musculature. Although conventional elastic tubing apparatus can provide resistance to strengthen the foot in simple directions such as dorsiflexion, it is difficult to properly orient the tubing to strengthen the foot and ankle in multiple directions. Furthermore, it is sometimes difficult to apply the tubing to the foot so that the resistance is applied in the appropriate direction (e.g. sub-talar inversion/eversion).

Currently prevalent foot and ankle strengthening techniques can help to strengthen the foot somewhat; however, these techniques are typically limited by one or more of:

- inadequate activation of the intrinsic musculature that controls movement of the foot and toes,
- difficulty in set-up of the apparatus and anatomical landmarking,
- lack of progressive resistance,
- lack of a way to measure resistance,
- unidirectional strengthening; and
- inability to provide eccentric loading.

Foot and ankle exercising devices that are described in the patent literature include:

- Johnson et al., U.S. Pat. No. 6,821,235 which discloses a foot-engaging element that can move in a spherical pattern and has elastic straps that provide resistance to movement.
- Kucharik et al. U.S. Pat. No. 4,739,986 discloses a foot ankle and lower leg exerciser that has two foot pedals mounted on a bar. A lower end of the bar has a ball joint that allows the foot pedals to be moved. A spring provides resistance to movement.
- Firster, U.S. Pat. No. 3,984,100 discloses a foot exerciser having a foot support to which can be attached weights or the like. A rounded member under the foot support allows the foot support to be pivoted relative to the floor.
- Kost, U.S. Pat. No. 2,206,902 discloses a device having foot platforms pivotally mounted to a base.
- Mason et al., U.S. Pat. No. 5,186,698 discloses an ankle exercise system comprising an elastic strap that can be attached to a user's forefoot.
- Aberton et al., U.S. Pat. No. 6,540,651 discloses exercise apparatus having a sock-like attachment structure. The attachment structure can be worn on a foot and has several different places to which one end of a resistance member can be attached. Another end of the resistance member can be attached to a structure;
- Williams, U.S. Pat. No. 4,371,161 discloses a foot exerciser having an elastic member extending between a foot-encircling strap and a brace attached to a user's lower leg;
- Fulton, U.S. Pat. No. 4,728,103 discloses a leg and ankle exercising device comprising a plate attached to handles by elastic limbs;
- Dyer, U.S. Pat. No. 6,110,078 discloses a device for stretching the foot. The device has two plates hinged together and a variable tensioning mechanism connected between the plates;
- Drago, U.S. Pat. No. 5,413,543 discloses a device for exercising the toes, foot and ankle. The device has a lower stationary platform that is attached to an upper movable platform by a platform spring. A toe gripping bar is mounted on a spring mechanism.
- Molloy, U.S. Pat. No. 4,478,414 discloses a device having a noose that wraps around a user's foot. The noose is attached to a securing strap by elastic members. The securing strap can be attached to the back of a chair.
- Collier, U.S. Pat. No. 5,039,093 discloses a device that has a ring-like structure that attaches around the upper leg. An elongated finger-like structure is attached to each of the user's toes by an elastic element.
- Chism et al, U.S. Pat. No. 5,582,579 discloses an orthopedic device which includes a boot that receives the user's foot and ankle. Manipulation straps attach to either side of the boot. A user can move the knee and ankle joints through flexion movements while applying tension on the manipulation straps.

A selection of other devices for exercising the foot and/or lower leg are disclosed in: Stodgell, U.S. Pat. No. 5,368,536; McLeod, U.S. Pat. No. 5,897,464; McIlvain et al. U.S. Pat. No. 5,749,668; Commisso, U.S. Pat. No. 6,878,102; Timmer, U.S. Pat. No. 6,811,523; Knight, U.S. Pat. No. 6,390,957; Hayes, U.S. Pat. No. 6,312,361; Lundberg, U.S. Pat. No. 6,109,990; Vathappallil, U.S. Pat. No. 6,063,013; Howd et al. U.S. Pat. No. 6,063,010; Thompson, U.S. Pat. No. 5,860,423; Foster, U.S. Pat. No. 5,645,516; Perez, U.S. Pat. No. 5,618,247; Jennings, U.S. Pat. No. 5,836,587; Johnston, U.S. Pat. No. 5,277,680; Bastow, U.S. Pat. No. 5,215,508; McIntyre, U.S. Pat. No. 5,178,596; Porter et al., U.S. Pat. No. 5,100,129; Powers, U.S. Pat. No. 5,004,228; Scott, U.S. Pat. No. 4,998,722; Kock, U.S. Pat. No. 4,979,737; Ostergard, U.S. Pat. No. 4,767,118; McIntyre, U.S. Pat. No. 4,650,183; Troxel, U.S. Pat. No. 4,605,220; Bangerter et al., U.S. Pat. No. 4,600,188; Martinez, U.S. Pat. No. 4,461,472; Lepley et al., U.S. Pat. No. 4,452,447; Hoyle et al., U.S. Pat. No. 4,337,939; White, U.S. Pat. No. 4,310,155; Leseberg, U.S. Pat. No. 4,251,070; Fiore et al., U.S. Pat. No. 4,186,920; Freeman Jr., U.S. Pat. No. 3,421,760; Matt Sr., U.S. Pat. No. 3,295,847; Loomis et al. U.S. Pat. No. 4,306,714; Scott, U.S. Pat. No. 4,998,722; Cunningham, U.S. Pat. No. 2,160,722; Marshman, U.S. Pat. No. 2,097,376; Gailey, U.S. Pat. No. 1,952,750; Anderson, U.S. Pat. No. 1,671,096; Kheiralla, U.S. Pat. No. 539,872; Gilchrist, US 2007/0287615; Nitta et al, US 2005/0043150; Backes et al. US 2005/0209067; and Knight, US 2002/0137608 A1.

There is a need for effective, practical apparatus and methods for strengthening muscles of the foot and lower leg.

SUMMARY OF THE INVENTION

The invention has a range of aspects. Embodiments of the invention provide apparatus for exercising the foot, toes and/or ankle.

One aspect of the invention provides exercise apparatus comprising a rigid member;

first and second straps connected to the rigid member at points spaced-apart along the rigid member at opposing ends thereof; first and second handles on the first and second straps respectively; a forefoot support member and first and second pairs of flexible resistance members coupled between the forefoot support member and the rigid member. The forefoot support member is configured to be attached to the foot of a user and comprises a transversely-extending foot-locating feature projecting on a superior surface thereof. The first pair of flexible resistance members coupled between corresponding first locations on the forefoot member that are in front of the foot-locating feature and corresponding first locations spaced-apart from one another on the rigid member. The second pair of resistance members is coupled between corresponding second locations on the forefoot member that are behind the foot-locating feature and corresponding second locations spaced-apart from one another on the rigid member. The forefoot support member is flexible about a substantially transverse axis located between the first locations on the forefoot member and the second locations on the forefoot member.

Another aspect of the invention provides exercise apparatus comprising: a forefoot member attachable to a forefoot of a user; and a plurality of resistance members connected to the forefoot member, the resistance members resisting motion of the forefoot member. The forefoot member is selectively positionable in a first position wherein the resistance members extend in a superior direction from the forefoot member and resist motion of the forefoot member in an inferior direction and a second position wherein the resistance members extend in an inferior direction from the forefoot member and resist motion of the forefoot member in a superior direction. The forefoot member comprises a transversely-extending ridge on the superior surface of the forefoot member over which a user can place the user's toes. The resistance members include resistance members attached to the forefoot member in front of the ridge and other resistance members attached to the forefoot member behind the ridge.

Another aspect of the invention provides exercise apparatus comprising: a rigid member; a plurality of elastically extendable resistance members connected to spaced-apart support points on the rigid member; foot-connection means for connecting the resistance members to a forefoot of a user; and member support means for selectively supporting the rigid member so that the foot-connection means are either superior to or inferior to the support points.

Other aspects of the invention provide exercise apparatus having combinations or sub-combinations of features possessed by one or more of the example embodiments described herein.

Further aspects of the invention and features of embodiments of the invention are illustrated and described in the accompanying drawings and detailed description.

BRIEF DESCRIPTION OF THE DRAWINGS

The accompanying drawings illustrate non-limiting example embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

This invention provides an exercise apparatus that may be used to exercise muscles of the foot, lower leg, knee, and hip of a user. The exercise apparatus may be useful in any of a wide variety of settings including rehabilitation clinics, gymnasia, home environments, etc. The exercise apparatus may be used for exercising the muscles of a wide variety of users including athletes (e.g. for injury prevention, improved performance), persons who are recovering from foot or ankle injuries, people who want to be in good overall shape, people who suffer from low strength of the muscles of the foot and ankle, and people who have poor balance (e.g. elderly). Exercise apparatus according to this invention may be made to be compact and light in weight. Such apparatus is advantageous for home use or for use by persons who are traveling.

The invention can be implemented in a range of different embodiments. Exercise apparatus according to example embodiments are described below. FIGS. 2A to 2E illustrate various movements of the foot and ankle that may take place while a user is using an exercise apparatus according to various embodiments of the invention. An exercise apparatus may provide resistance to some or all of these motions of the foot/ankle.

In the illustrated example embodiments, a resistance system couples a user's foot to support points and the support points can be held so that the resistance system resists motion of the user's foot in a superior direction or resists motion of the user's foot in an inferior direction. Thus the same apparatus can be used for exercises involving dorsiflexion of the user's ankle and for exercises involving plantarflexion of the user's ankle. In the illustrated embodiments, the support points are provided by a rigid member that can be held in place by a part of the user's body other than the foot/ankle being exercised. For example, the rigid member may be held by:

the user's hand or hands; or the non-exercising foot.

Figure 1A:
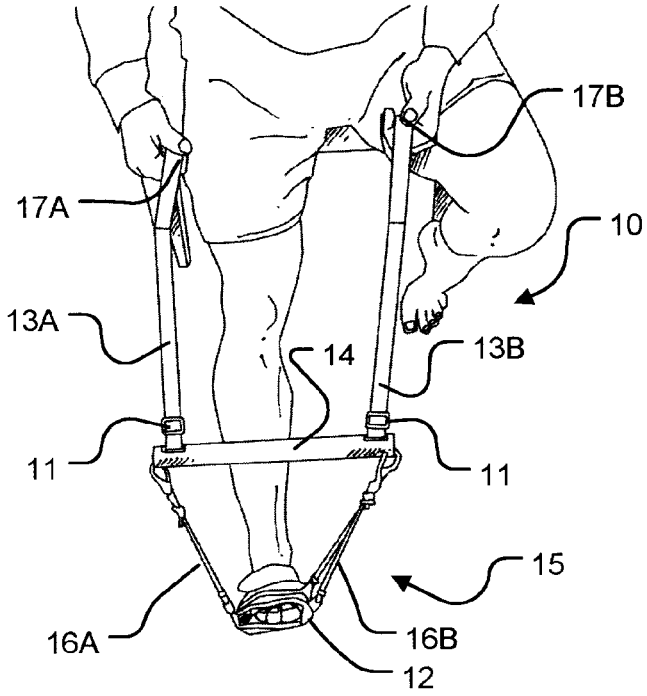
FIG. 1A is a front elevation view of a foot exercise apparatus according to an embodiment of the invention.
Figure 1B:
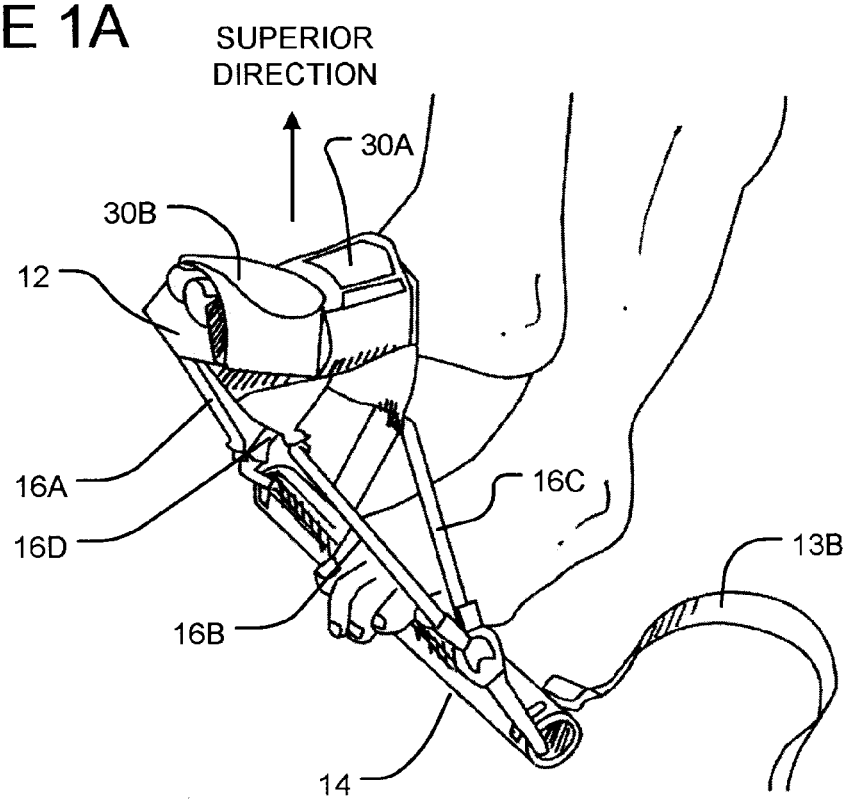
FIG. 1B is a front elevation view of the foot exercise apparatus of FIG. 1A configured to provide resistance to foot motions that cause a forefoot support to move in a superior direction.

FIGS. 1A and 1B show foot exercise apparatus 10 according to one embodiment. Foot exercise apparatus 10 comprises a forefoot member 12 coupled to a rigid member 14 by a resistance system 15. In the illustrated embodiment, resistance system 15 comprises elastic resistance members 16A and 16B. Rigid member 14 is in turn, attached to flexible straps 13A and 13B that are adjustable in length to permit adjustment of the resistance offered by apparatus 10 to motions of the foot.

In some embodiments, rigid member 14 is flattened on one side. The flattened side may be placed against the floor. A user can hold rigid member 14 against the floor with one foot while exercising the other foot. Rigid member 14 may comprise a depression, notch or pocket or other contoured feature on a side opposed to the flattened side to receive a foot holding rigid member 14 against the floor.

Resistance members 16A and 16B are preferably connected to support points that are spaced apart along rigid member 14 by a distance sufficient to allow for an approximate angle of 45 degrees between lines extending along the elastic members and a line extending laterally outward in the plane of forefoot member 12 when forefoot member 12 is at a comfortable position for subtalar inversion or eversion. This facilitates providing a desirable resistance torque around the longitudinal axis of the foot during movements of subtalar inversion and eversion (see FIG. 2E).

Flexible straps 13A and 13B are attached to a handle or handles 17A, 17B that the user can hold onto during exercise. In the illustrated embodiment, straps 13A and 13B can be shortened or lengthened so that when handles 17A and 17B are in a neutral position, the tension in resistance members 16 offers a desired resistance to movements of ankle plantarflexion, supination, pronation, foot flexion, and toe flexion. The tension in the resistance members may be increased by pulling back on one or both of handles 17. For example, a user may control the tension to be suitable for a passive range of motion exercise or to provide eccentric loading of one or more muscle groups of the foot and ankle.

Rigid member 14 may have a foot support, such as a centrally-located pad, foot plate, curved section or indented section which can receive the underside of a user's non-exercising foot in order to stabilize apparatus 10 while the foot being exercised is making movements of ankle dorsiflexion, foot extension, and/or toe extension. By holding rigid member 14 in place with a non-exercising foot, a user can also use apparatus in a mode in which the user exercises by pulling forefoot support 12 in a superior direction (e.g. toward the user's upper body) relative to rigid support 14.

In FIG. 1A, exercise apparatus 10 is configured to resist motion of foot support 12 in an inferior direction. FIGS. 1B, 1E, and 1F illustrate how forefoot member 12 can be repositioned relative to rigid member 14 such that the resistance system 15 resists motion of forefoot member 12 in a superior direction. When resistance system 15 is resisting motion in the superior direction the user can hold rigid member 14 in place with his or her non-exercising foot. The user can also hold straps 17A and 17B to steady rigid member 14. To increase the stabilization of the exercising limb and/or to increase the resistance applied to the forefoot member (for example to provide eccentric loading), the user may place his/her hand, forearms, and/or pillows or the like under the thigh of that limb and maintain that position for the duration of the exercise. Thus exercise apparatus 10 allows exercising of the foot/ankle while moving the foot and ankle in opposing directions (or holding the foot/ankle against forces exerted by resistance system 15).

Apparatus 10 may be constructed to develop resistance forces of different magnitudes to:

movements of ankle dorsiflexion;

movements of toe extension;

movements of ankle plantarflexion; and, movements of toe flexion.

For example, the apparatus illustrated in FIG. 1B, may be configured to provide a resistance torque for movements of ankle dorsiflexion and movements of toe extension that is less than (e.g. on the order of one half as great as) the resistance torque provided to movements of ankle plantarflexion and toe flexion.

In the illustrated embodiment, this differential resistance can be obtained by placing the heel of the exercising foot directly above the mid-section of the non-exercising foot that is holding rigid bar 14 in place. Additional stability can be achieved by placing the heel of the exercising foot on the superior aspect of the non-exercising foot, at the junction between the foot and lower leg (see FIG. 1E). In so doing, the resistance lever arms for the movements of ankle dorsiflexion and toe extension are reduced by approximately half in comparison to the resistance lever arms experienced during ankle plantarflexion and toe flexion (see FIGS. 1E and 1F). The associated reduction in resistance torque may allow for an approximate ratio of 2:1 for plantarflexion vs. dorsiflexion resistance, and toe flexion vs. toe extension resistance, thereby maintaining the desired ratio according to the typical strength ratio between these movements.

The apparatus shown in FIG. 1A may alternatively be used by attaching handles 17A and 17B to a fixed object such as the leg of a piece of furniture or the like. A user can then position himself or herself relative to apparatus 10 so that opposing movements may be performed.

Figure 1C:
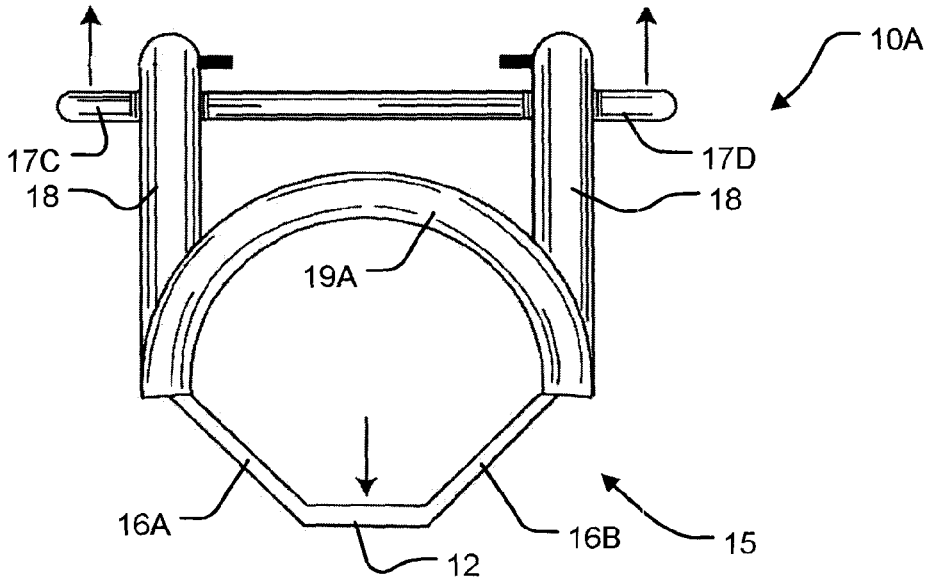
FIG. 1C is a front elevation view of a foot exercise apparatus according to another embodiment.
Figure 1D:
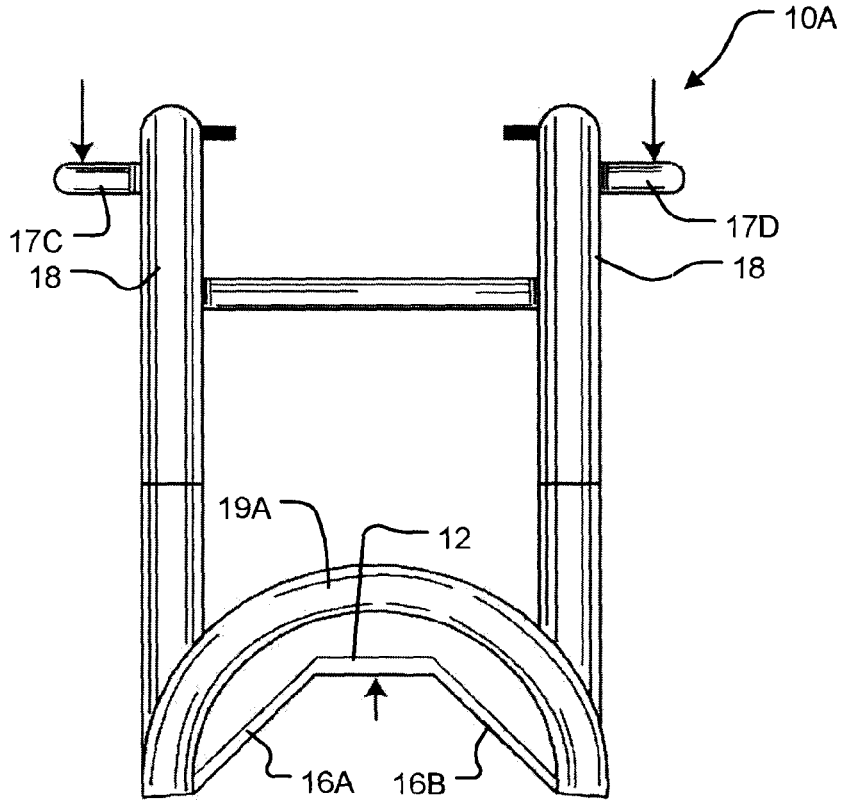
FIG. 1D is a front elevation view of the foot exercise apparatus of FIG. 1C configured to provide resistance to foot motions that cause a forefoot support to move in a superior direction.
Figure 1E:
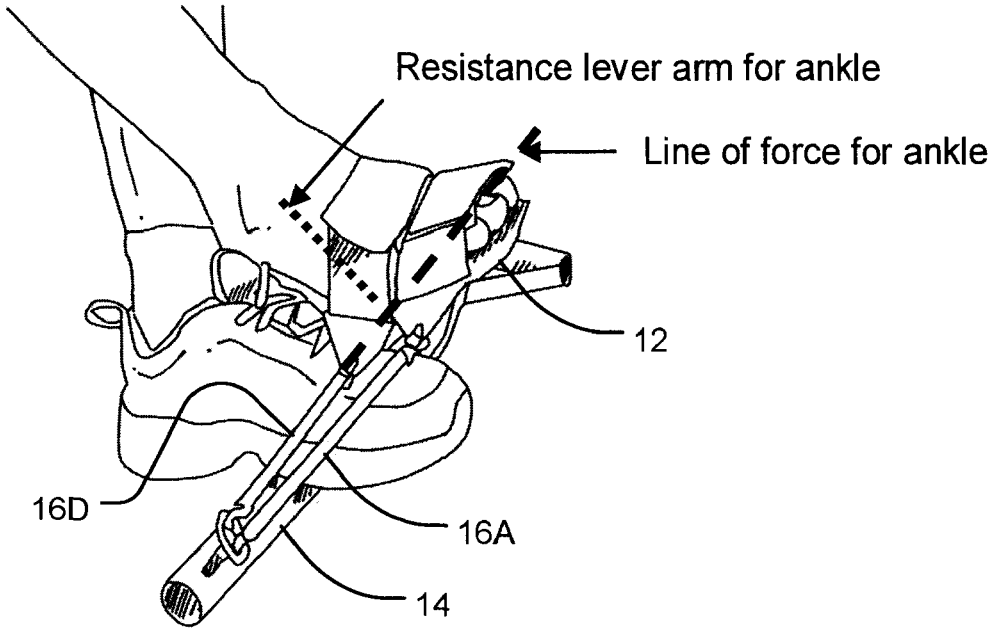
FIGS. 1E and 1F are isometric views of an apparatus like that of FIGS. 1A and 1B being used by a user.
Figure 1F:
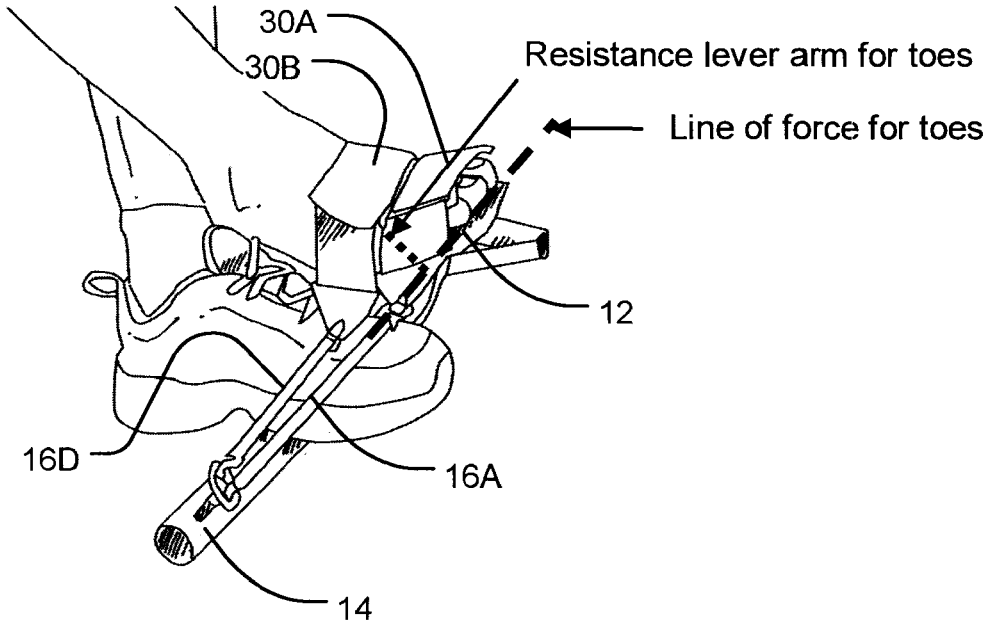

FIGS. 1C and 1D illustrate an exercise apparatus 10A according to another embodiment of the invention. Exercise apparatus 10A has a forefoot member 12 connected by a resistance system 15 to a rigid frame 18. Frame 18 comprises one or more rigid members that provide support points to which ends of resistance members 16 are attached. Frame 18 may be constructed from a suitably strong material such as high-strength plastic, metal or the like. The shape and configuration of frame 18 may be different from that which is illustrated. Telescoping handles 17C and 17D can be varied in length to adjust the tension that resistance members 16 provide when handles 17C and 17D are being held in positions that are comfortable for the user.

In the illustrated embodiment, frame 18 comprises an arched cross member 19A. The arch in cross member 19A provides clearance to permit forefoot support 12 to be moved in a superior direction (toward handles 17C and 17D).

A user can apply downward pressure against handles 17C and 17D to secure frame 18 in place. For the situations described above, the user may flex the knee and hip of the exercising limb to move forefoot support 12 away from the support points to which resistance members 16 are attached and to thereby increase the resistance provided by resistance members 16. To increase the stabilization of the limb, the user may place pillows or the like under the thigh of that limb and maintain that position for the duration of the exercise.

Figure 1G:
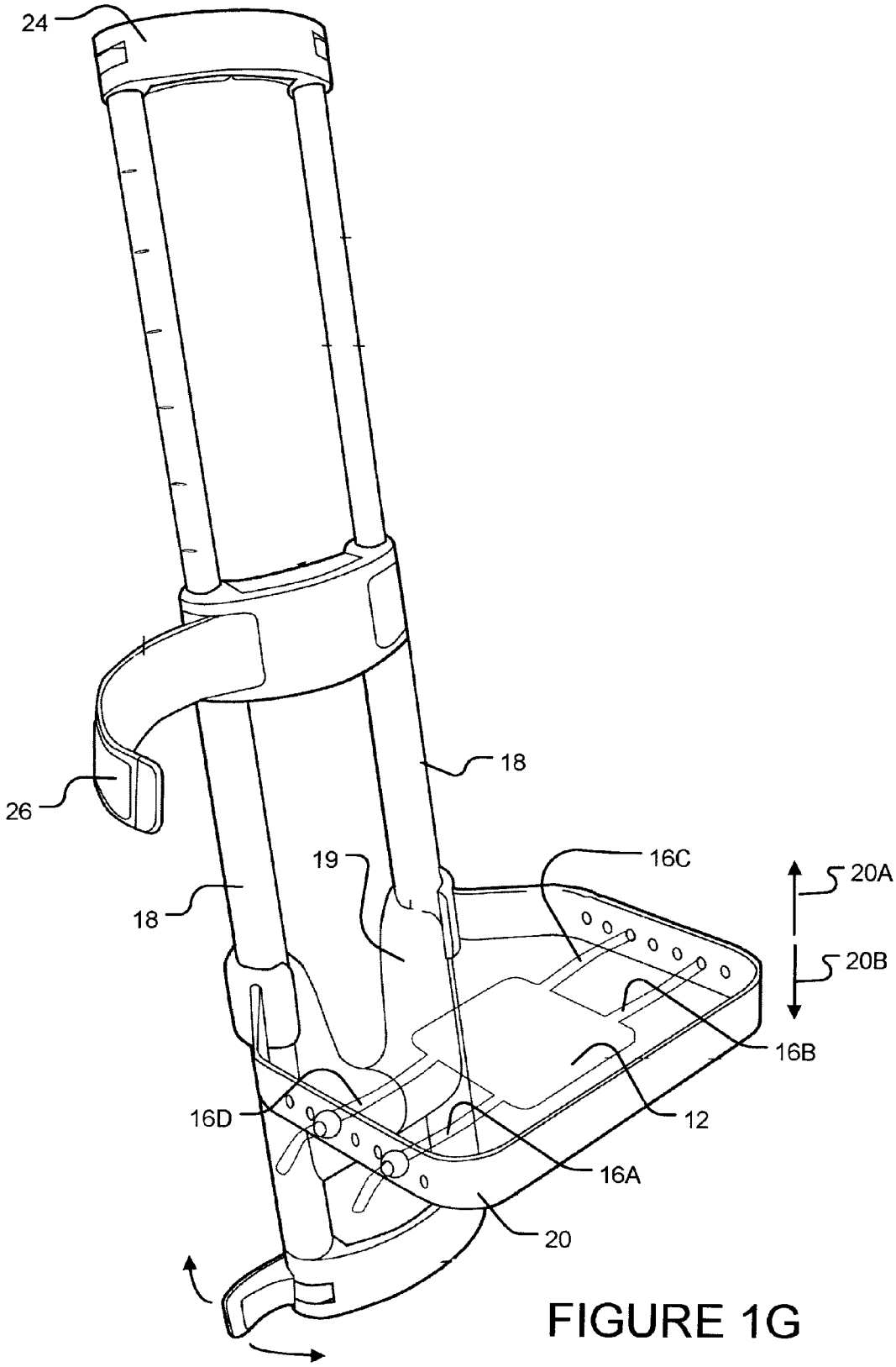
FIG. 1G is a perspective view of a foot exercising device according to another embodiment.
Figure 2E:
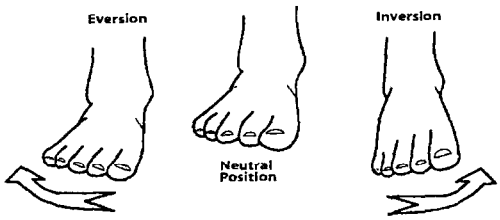
FIGS. 2A through 2E illustrate motions of the foot and ankle, some or all of which may be resisted by exercise apparatus according to embodiments of the invention.
Figure 2D:
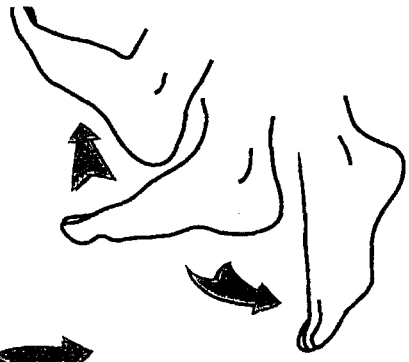
Figure 2B:
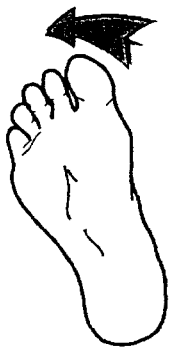
Figure 2A:
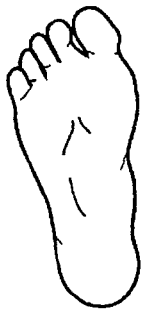
Figure 2C:
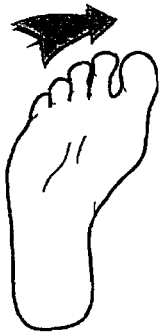

FIG. 1G illustrates an exercise apparatus 10B according to another embodiment of the invention. Exercise apparatus 10B comprises a frame 18 and provides a heel support 19. A user can place the heel of a foot being exercised on heel support 19. In exercise apparatus 10B, forefoot member 12 is coupled by a resistance system 15 to a bracket 20 that is movable in a superior direction (as indicated by 20A) or an inferior direction (as indicated by 20B) relative to heel support 19. By adjusting the position of bracket 20 a user can configure exercise apparatus 10B such that resistance system 15 resists foot motion of forefoot member 12 in either a superior or inferior direction. This permits a user to exercise the muscles that move the foot and ankle in opposing directions.

In exercise apparatus 10B, the position of forefoot member 12 can be adjusted forward or backward relative to heel support 19 to accommodate users with different foot lengths. This may be achieved by adjusting the locations at which elastic members 16A, 16B, 16C and 16D connect to bracket 20. A slotted track (not shown in FIG. 1G) may be provided on bracket 20 to facilitate positioning forefoot member 12 toward or away from heel support 19. Exercise apparatus 10B provides a support handle 24 on frame 18. During foot/ankle exercise, a user can hold support handle 24 while resting the bottom of frame 18 on the ground so that frame 18 is held steady during exercise. An optional strap 26 may be provided to secure frame 18 to the leg supporting the foot/ankle that a user is exercising.

In apparatus 10B, the tension in resistance members 16 may be adjusted by moving bracket 20 up or down on frame 18. Suitable clamps or other locking mechanisms may be provided to hold bracket 20 at a selected position along frame 18.

The apparatus of any of the embodiments described above can be made to be readily portable. Members of the apparatus may be telescopic so that they can be put into a compact configuration for storage or transportation.

A user can use the apparatus of any of the embodiments described above by placing his or her foot on the forefoot member 12 and fastening straps 30 to secure the user's forefoot and toes to the forefoot member 12. When the forefoot member is positioned such that it is inferior relative to the support points (as shown for example in FIGS. 1A and 1C), the user can move his or her foot, toes, and ankle in various ways against the resistance provided by resistance members 16 to exercise the user's foot, ankle, and/or toes as described in more detail below. From this position, movements of ankle plantarflexion, foot flexion, toe flexion, supination, and pronation may be performed individually or in combination.

When forefoot member 12 is positioned such that resistance members 16 exert tension in a superior direction relative to forefoot member 12 (as shown for example in FIGS. 1A, 1C), movements of ankle plantarflexion, foot flexion, toe flexion, and subtalar inversion and eversion, or a combination thereof, can be performed. When forefoot member 12 is positioned such that the resistance members exert tension in an inferior direction relative to the forefoot member 12 (as shown for example in FIGS. 1B, 1D), opposing movements of ankle dorsiflexion and toe extension, supination, pronation or a combination thereof, can be performed.

Figure 3:
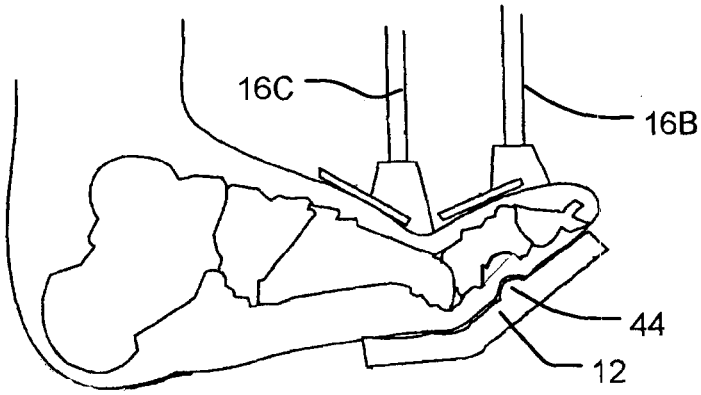
FIG. 3 is a longitudinal elevational sectional view of an apparatus according to an embodiment of the invention applying resistance to toe flexion of a user's foot.
Figure 4:
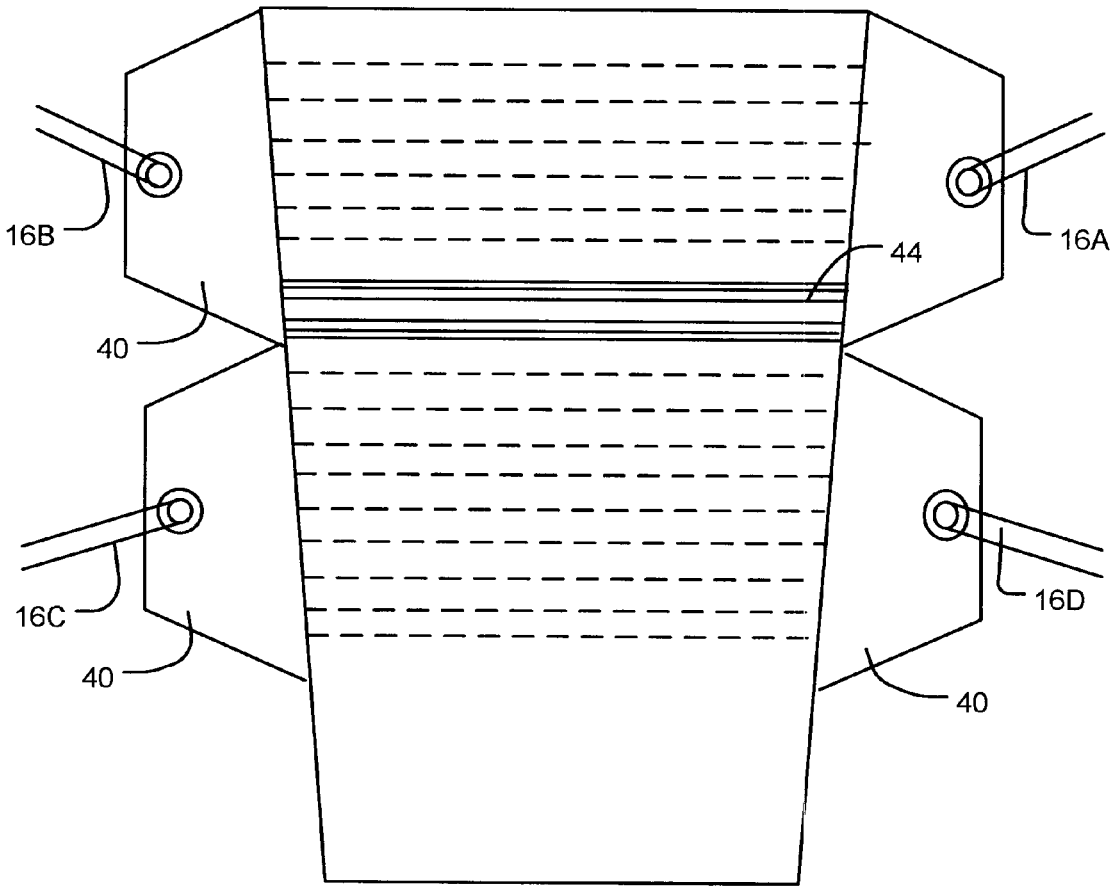
FIG. 4 is a top view of an example embodiment of a forefoot member.
Figure 5A:
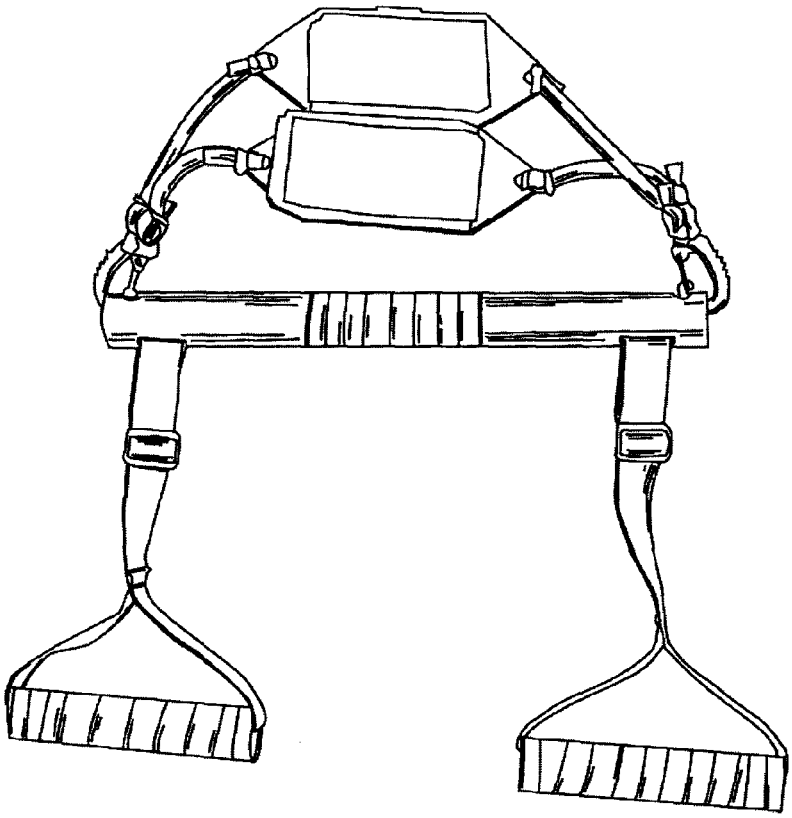
FIGS. 5A through 5H are diagrams illustrating features of construction of a prototype embodiment similar to the embodiment of FIGS. 1A and 1B.
Figure 5B:
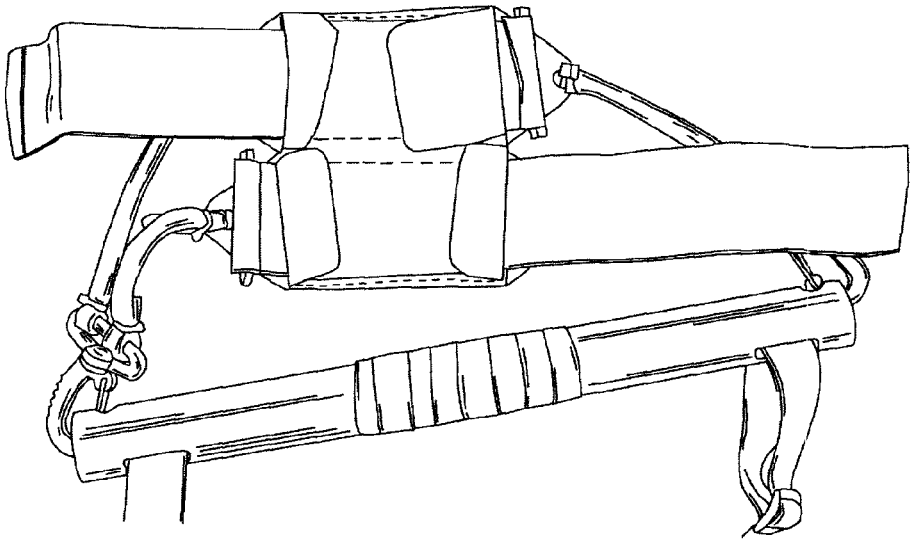
Figure 5C:
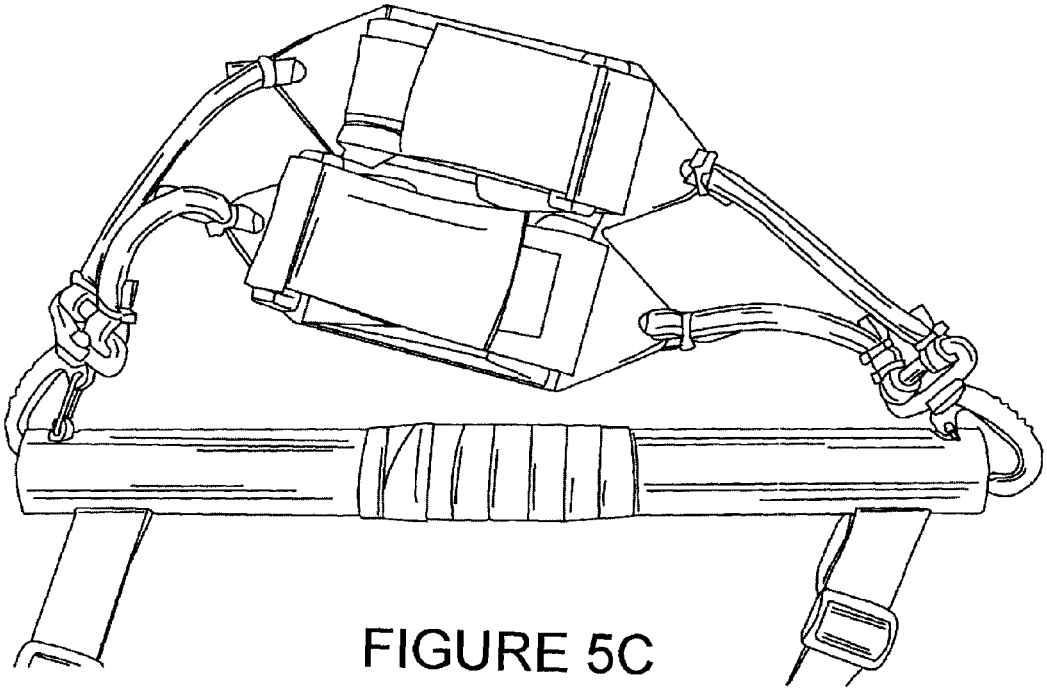
Figure 5D:
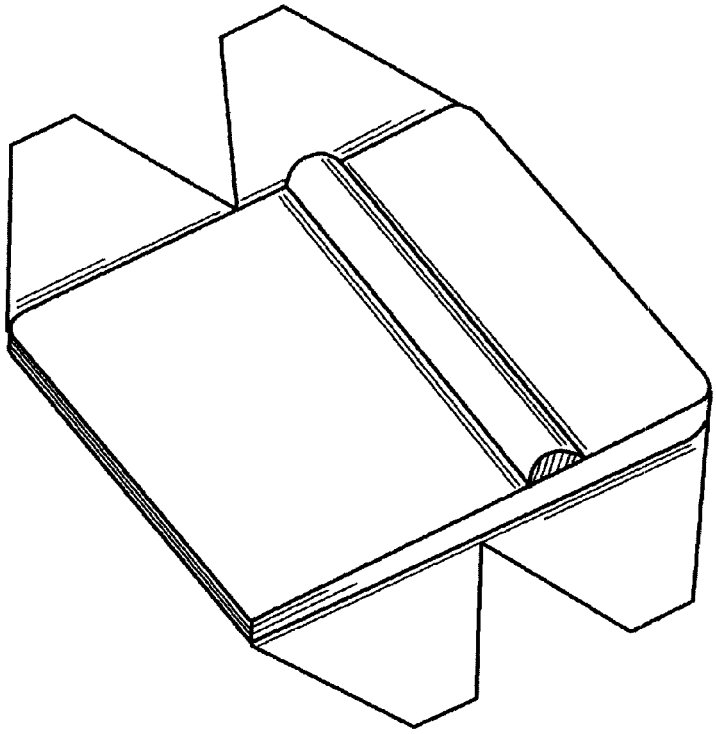
Figure 5E:
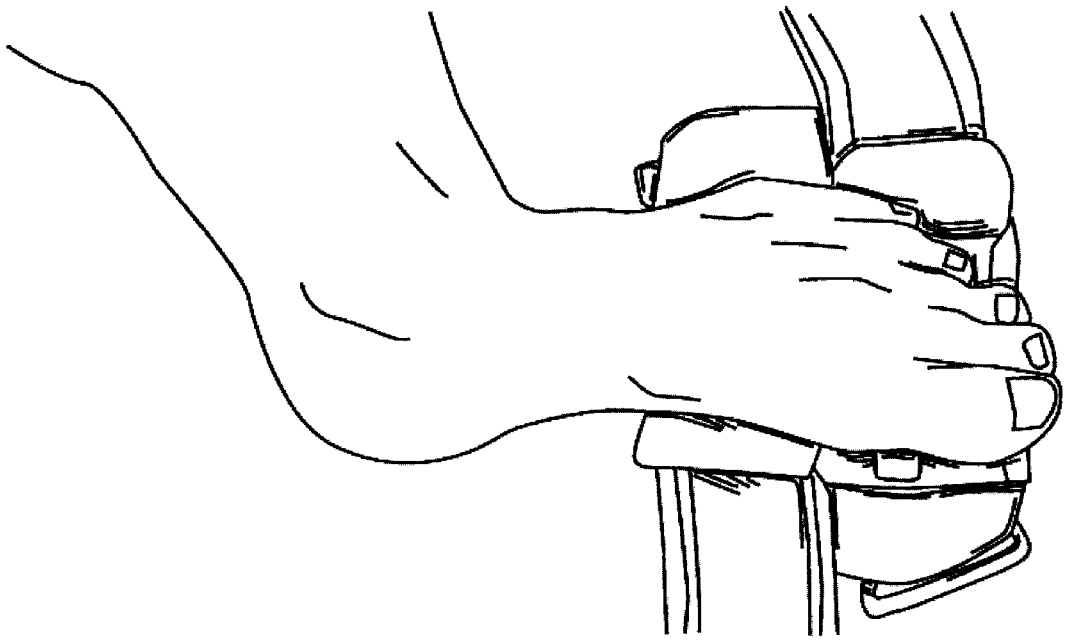

Apparatus according to the above embodiments may be set up to suit a user's physical characteristics and used in ways which may involve:

- Adjusting the length of a tensioner strap 13 with tensioner adjustment clips 11 (FIG. 1A).
- Moving forefoot member 12 to a position that is superior to support points for resistance members 16 by placing the opposing (non-exercising) foot on a central portion of rigid member 14 to stabilize rigid member 14, placing the heel of the exercising foot on the superior aspect of the non-exercising foot at the junction between the foot and lower leg, and grasping the back of the opposing thigh to increase the resistance in the resistance members 16 and to stabilize the limb (FIG. 6J);
- Affixing handles 17 to a rigid object or having another person hold handles 17 so that opposing movements of the foot and ankle may be performed (FIG. 6I).
- Adjusting the length of the telescoping members (FIG. 1D).
- Moving the forefoot member closer to the rigid frame (FIG. 1D) so that resistance members 16 exert tension in an inferior direction to forefoot member 12, to allow for opposing movements of the foot and ankle.
- Pulling or pushing against the handles in FIG. 1C or 1D, depending on whether resistance members 16 exert tension in a superior or inferior direction relative to the forefoot member, respectively.
- Placing the forefoot member superior or inferior to a fixed heel support, and adjusting the position of the forefoot member relative to the heel support in a forward or backward direction (FIG. 1G).
- Having the user place his or her forefoot on the forefoot member, wherein the forefoot member comprises a foot-locating feature (such as ridge 44; see e.g. FIGS. 5D and 5E), allowing the user to align an anatomical feature of his or her foot with the foot-locating feature, which thereby allows for alignment of resistance members with anatomical landmarks on the user's foot (see e.g. FIGS. 3 and 4).

Figure 5F:
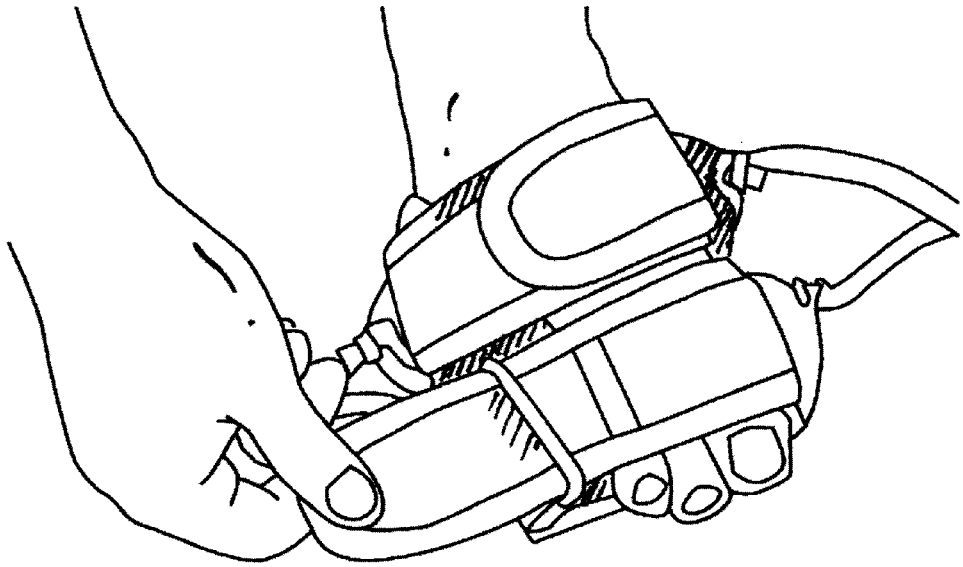

Strapping the user's forefoot and toes to forefoot member 12 with straps 30 (FIG. 5F).

Figure 5G:
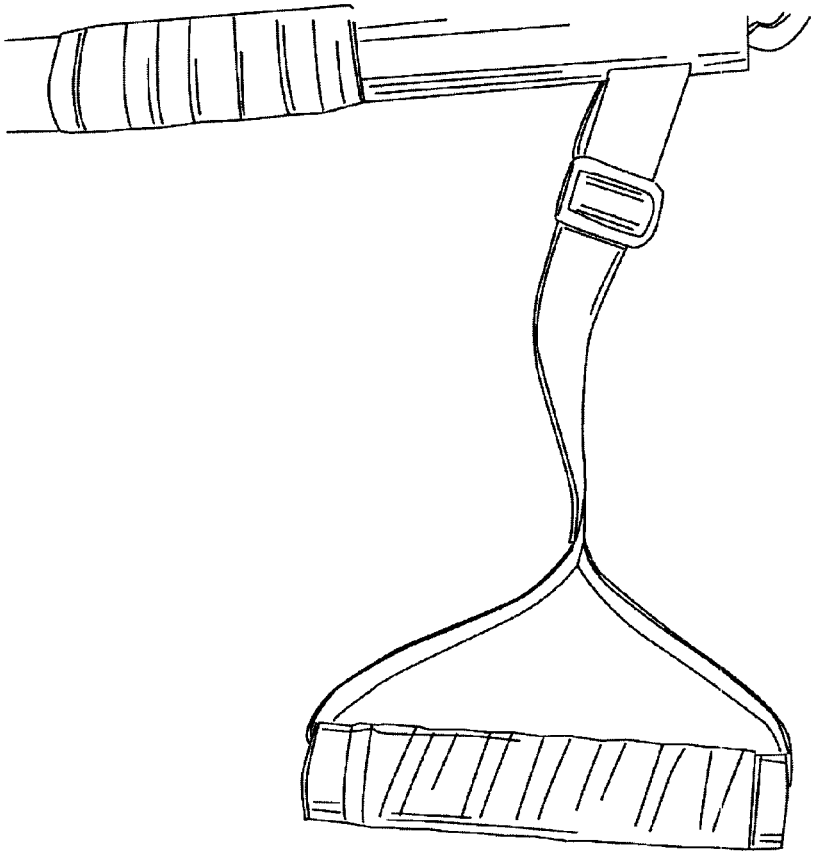

Readjusting the length of the tensioner straps if necessary (FIGS. 1A and 5G).

Adjusting the length of the telescoping members if necessary (FIG. 1D).

Having the user perform a desired number of repetitions from a seated or standing position.

Having the user repeat with the opposite foot, if necessary or desired.

Figure 6A:
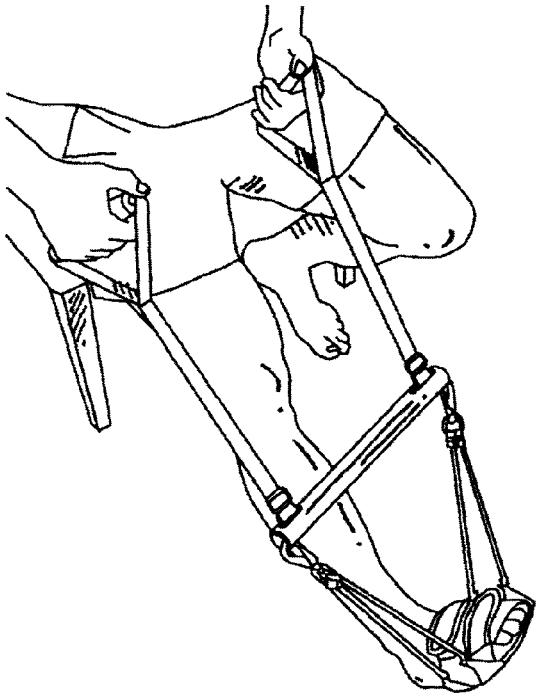
FIGS. 6A through 6I are diagrams illustrating various foot and ankle exercises that may be performed using a foot and ankle exercise device according to an example embodiment.
Figure 6B:
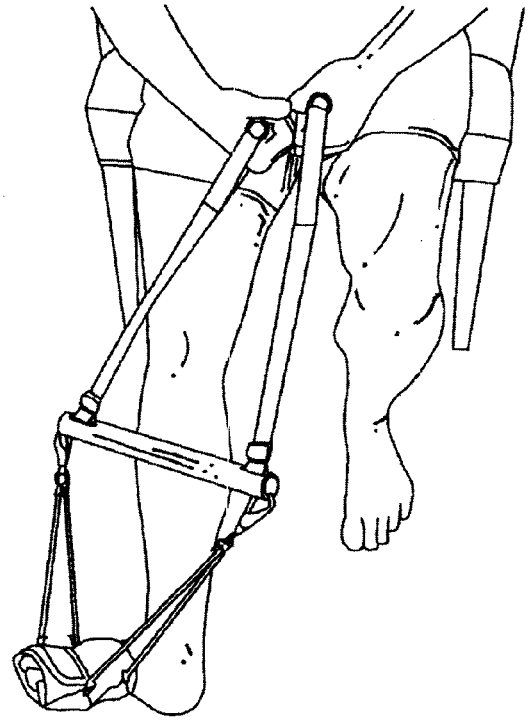
Figure 6C:
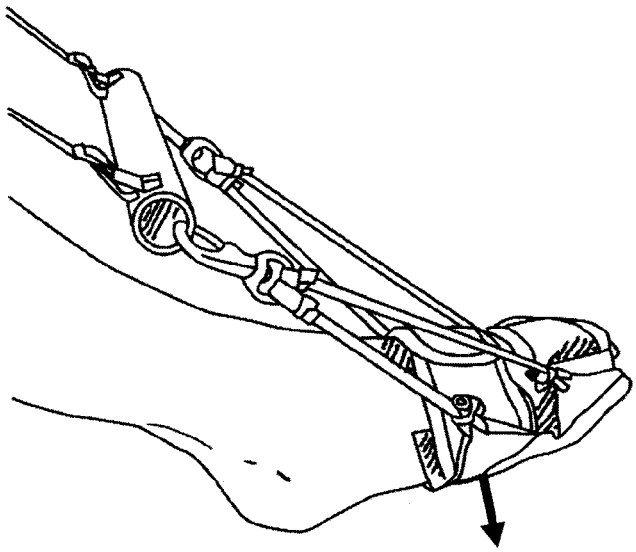
Figure 6D:
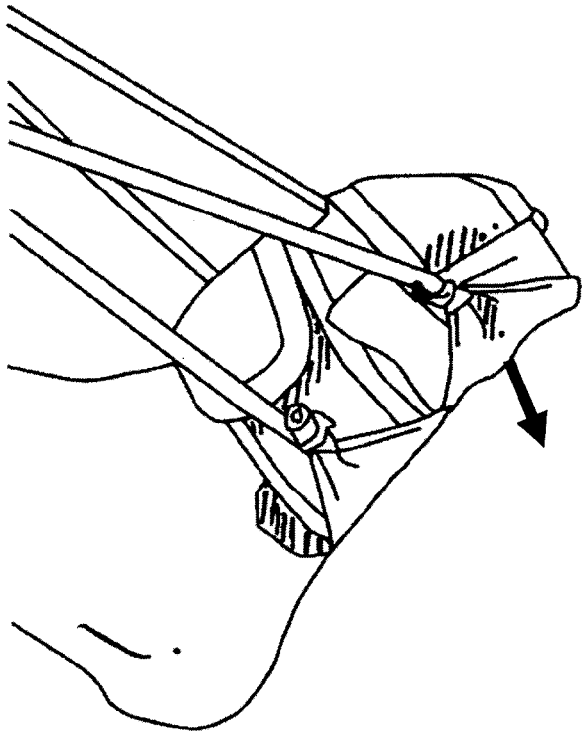
Figure 6E:
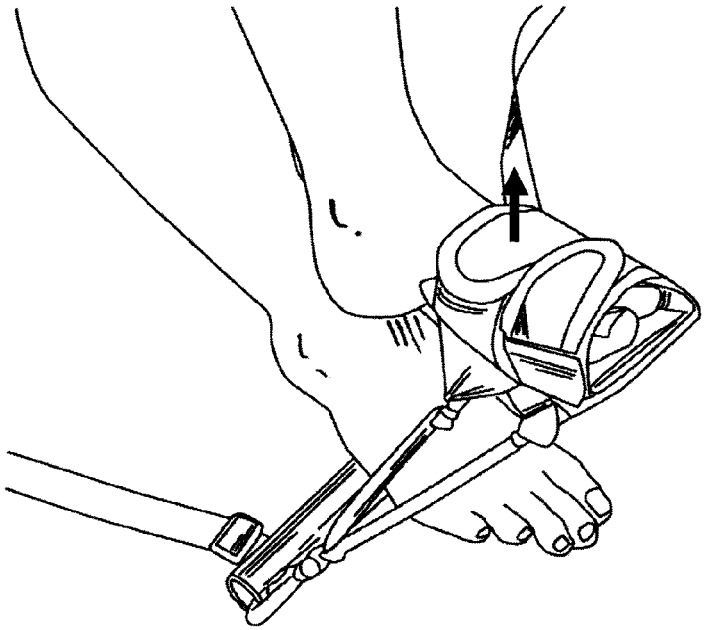
Figure 6F:
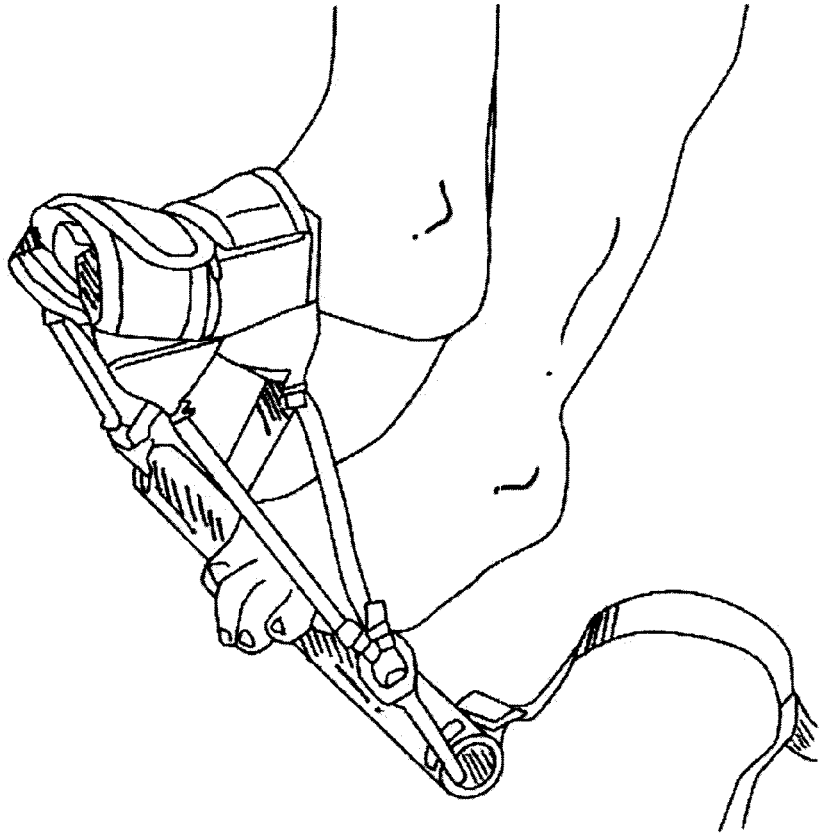
Figure 6G:
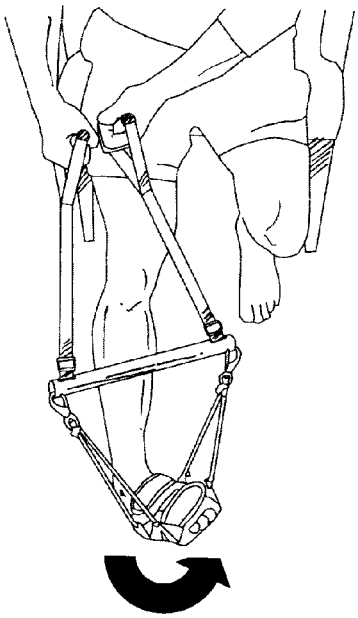
Figure 6H:
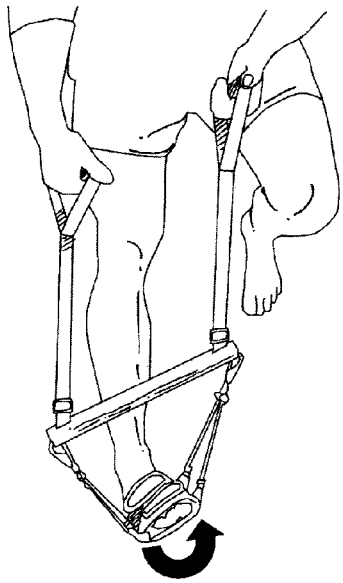
Figure 6I:
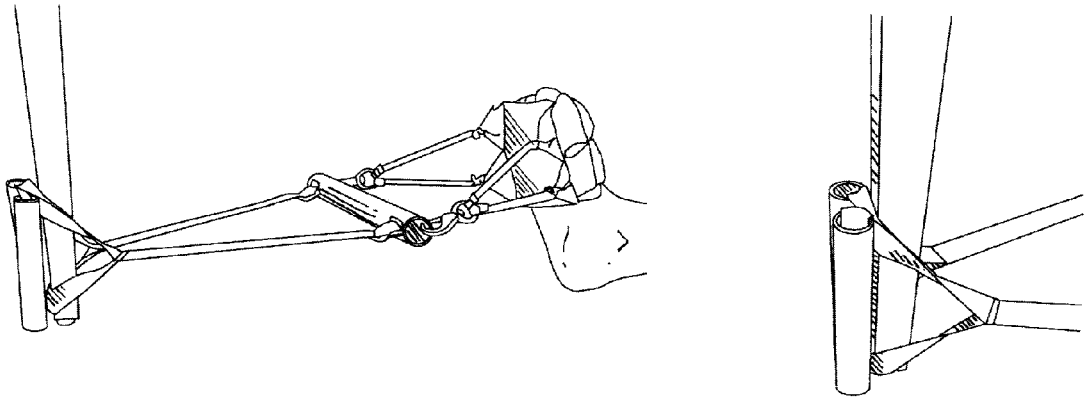

As treatment or strengthening progresses, the resistance can be increased as described herein (see e.g. FIGS. 6A, 6H and 6J).

In the above-described embodiments, resistance system 15 is coupled to a foot being exercised by way of a forefoot member 12. Forefoot member 12 provides a surface on which a user can place his or her forefoot. The distal aspect (nearest the toes) of forefoot member 12 may be flexible about a transverse axis so that it can bend under the pressures applied by a user's toes to allow for a full range of joint motion of the interphalangeal (IP) and metatarsal-phalangeal (MTP) joints (See FIG. 3). Preferably, the forefoot member is flexible along half its length (typically along approximately 3 inches (about 7½ cm)) to accommodate 90% of typical adult phalangeal lengths) on the distal aspect so that it interferes minimally with rotations of the IP joints in the toes and the MTP joints in the forefoot. These joints can occur at different positions along the length of the foot in different people. The distal aspect of the forefoot member may be multi jointed at small increments (½ cm or less in some embodiments) along its length to accommodate this non-uniformity (see FIG. 4, for example).

Any suitable securing mechanism may be provided to secure a user's toes and forefoot in place on forefoot member 12. Straps 30 on forefoot member 12 can be used to strap a user's foot to the forefoot member 12. The illustrated embodiments provide two straps 30A and 30B that can be used respectively to secure a user's forefoot and toes to forefoot member 12 (see e.g. FIGS. 5B and 5F). Straps 30 may be elastic or non-elastic. Straps 30 may be fastened over the user's foot with suitable fasteners such as Velcro™ or other hook-and-loop fastener material. In the illustrated embodiment, straps 30 are attached to opposite sides of forefoot member 12. Straps 30 may pass through corresponding loops, buckles or similar attachments on the opposite side of forefoot member 12 and then pulled so that they are tight over the top of the user's foot and toes. Straps 30 can be fastened to secure the user's foot and toes to forefoot member 12.

In the embodiments described above, resistance system 15 provides resistance to motion of forefoot member 12 and/or applies forces to forefoot member 12 that a user can work against by moving his or her foot, toes, and/or ankle. In the illustrated embodiments, resistance system 15 comprises a number of extendable resistance members 16 (individually identified as 16A, 16B, 16C and 16D) that are connected between forefoot member 12 and support points. The various embodiments described above differ in respect to the structure that provides the support points to which the remote ends of resistance members 16 connect. As forefoot member 12 is attached to support points by resistance members 16, it can be moved in any direction in the plane of the frame. The resistance members also provide forces that resist motions of forefoot member 12 outside the plane of the frame.

In some embodiments, resistance members 16 comprise elastic members such as stretchable tubes, bands or straps, for example. Resistance members 16 are not necessarily elastic all along their lengths. Resistance members 16 may comprise non-elastic sections, such as sections of cable or rigid links. In such embodiments, forces may be applied to forefoot member 12 by way of springs or powered actuators that pull on resistance members 16. In some embodiments, resistance members 16 may comprise members that are substantially inelastic. Such embodiments may be useful for passive exercises of the foot and/or ankle.

Some embodiments provide a plurality of interchangeable resistance members 16. The interchangeable resistance members 16 may comprise resistance members 16 that are elastic and other resistance members 16 that are inelastic. Where inelastic resistance members 16 are provided there may be a plurality of different inelastic resistance members 16 having different lengths. The interchangeable resistance members 16 may comprise a plurality of elastic members that have different degrees of stretchiness (i.e. different elastic coefficients).

Figure 5H:
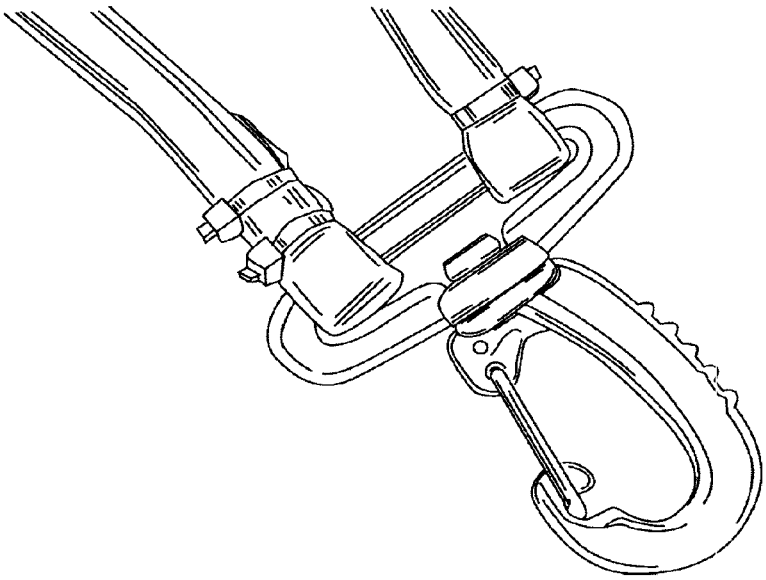

Resistance members 16 may be connected to a forefoot member 12 in any suitable way. For example, resistance members 16 may pass through tunnels, sleeves, or similar passageways under or through the forefoot member. In some embodiments, resistance members 16 are detachably coupled to forefoot member 12 and/or rigid member 14 by means of suitable clips (see FIG. 5H). The clips may be detached to permit forefoot member 12 to be used with different combinations of resistance members 16, to alter the points of attachment of resistance members 16 on forefoot member 12 and/or to allow a user to disconnect from the rest of the exercise apparatus without taking off forefoot member 12.

An example embodiment of a forefoot member is shown in FIG. 4. In this embodiment, flexible tabs 40 of durable material (for example: neoprene, a strong fabric, or the like) are attached to the forefoot member (for example by stitching, laminating, riveting or the like). Tabs 40 project laterally from forefoot member 12. Resistance members 16 are each attached to one of tabs 40. For example, resistance members 16 may pass through grommets or the like located near the ends of tabs 40 or may be stitched, riveted, or otherwise attached to tabs 40. Tabs 40 may comprise the transversely-projecting ends of strips of material that extend transversely across the forefoot member. Tabs 40 may be tapered, as shown. Tapered tabs distribute forces evenly under a user's toes and distal metatarsal bones. The material of tabs 40 is substantially inelastic in some embodiments.

Tabs 40 in the distal aspect of forefoot member 12 may have sufficient width that they act on the forefoot member over an area that extends longitudinally along the forefoot member for distances sufficient to accommodate differences in the length of toes of the majority of different users. For example, in some embodiments of the invention, portions of tabs 40 that pass under forefoot member 12 have widths in the range of about 5 cm to 6 cm.

In the embodiment illustrated in FIG. 4, a first set of resistance members 16A and 16B acts on forefoot member 12 at a longitudinal location approximately corresponding with the expected position of the mid-point of the proximal phalanges of the user's first three toes, with the force being distributed via the flexible tabs 40 over the majority of the phalanges. A second set of resistance members 16C, 16D acts on forefoot member 12 at a longitudinal location approximately corresponding with the expected position of the distal third of the user's metatarsals.

The distal aspect of forefoot member 12 may be substantially rigid in the medial-lateral (torsional) direction, to prevent bowing of the forefoot member under forces exerted by resistance system 15, which may place undue stress on the user's toes. In preferred embodiments, the proximal aspect (nearest the heel) of forefoot member 12 is flexible along its length and in the medial-lateral direction to allow for a more secure fit of the forefoot support around the mid-section of the foot to prevent slippage of the foot during full range of motion exercise.

In alternative embodiments, the entire forefoot member 12 may be semi-rigid or rigid to isolate specific joint movements. In some embodiments, forefoot member 12 comprises a removable stiffener that extends longitudinally along the forefoot member. The stiffener may be inserted to increase the stiffness of the forefoot member in respect of bending moments about transversely-extending axes or removed to make the forefoot member 12 more flexible. Different stiffeners may be provided to achieve different degrees of flexibility.

Figure 3A:
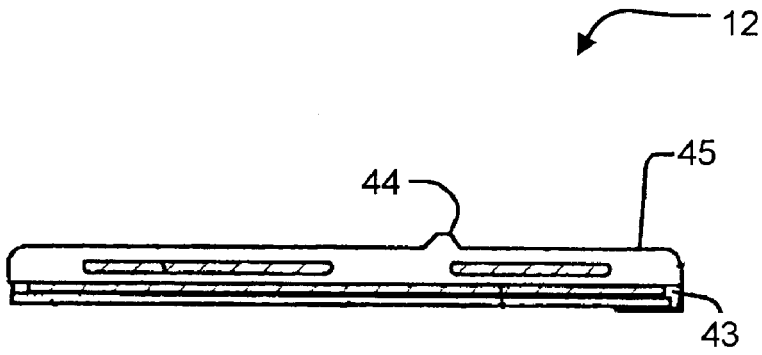
FIG. 3A is a longitudinal elevational sectional view of a forefoot member.

For example, FIG. 3A shows a section through a forefoot member 12 having a longitudinally-extending pocket 42 that receives a removable stiffener 43. A stiff stiffener 43 can prevent relative movements of the foot and toes. This can be desirable to isolate ankle movements. A forefoot member 12 may be stiffened by a plate or the like that sits under the foot or attaches to a lower surface of the forefoot member as an alternative to an internal stiffener.

In currently preferred embodiments, the forefoot member is tapered such that the proximal end (nearest the heel) is smaller in width than the distal end (nearest the toes) as shown, for example, in FIG. 4. This design permits the forefoot member to conform closely to the shape of the user's foot, thereby more firmly securing the forefoot member to the user's foot, so that it resists coming off during movement.

Forefoot member 12 preferably has a foot-locating feature that assists a user to place his or her foot so that the approximate mid-point of the proximal phalange of the great toe lies longitudinally between points where proximal and distal sets of resistance members couple to forefoot member 12. For example, the forefoot members 12 shown in FIGS. 3 and 4 each have a transversely-extending ridge 44 on the superior surface 45 over which the user places his/her toes. Ridge 44 comprises a feature or pattern of features that project from superior surface 45. Resistance members 16A and 16B attach in front of ridge 44 while resistance members 16C and 16D attach behind ridge 44. The user can align the approximate mid-point of the proximal phalange of the great toe (i.e. the sulcus) with the center of ridge 44.

By placing the toes over ridge 44, proper alignment of the distal metatarsals with respect to forces that resist motions of the foot around the ankle joint as well as alignment of the phalanges with respect to forces that resist motions of the toes around the MTP joints can readily be achieved.

Figure 3B:
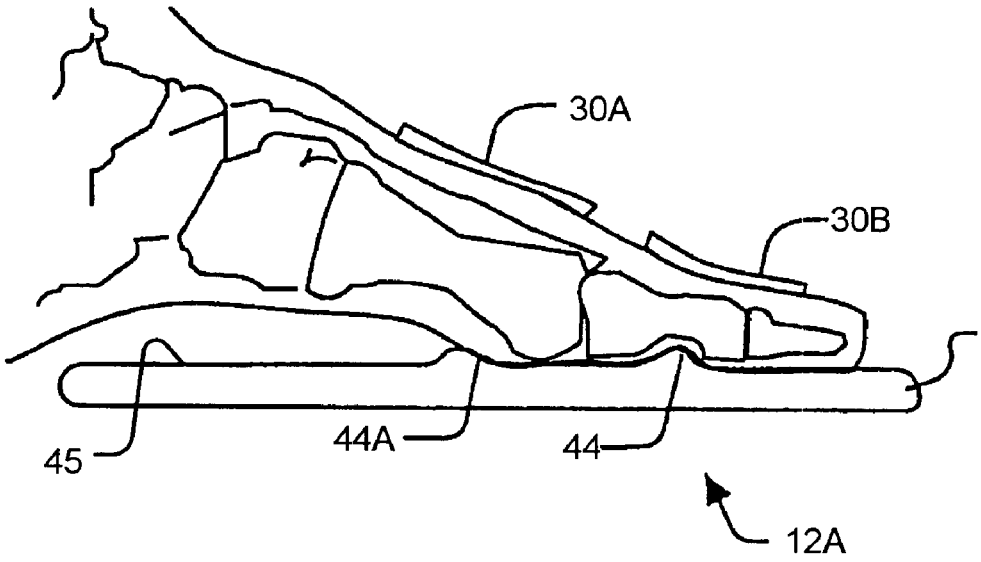
FIG. 3B is a longitudinal elevational sectional view of an alternative forefoot member having two foot-locating features.

Forefoot member 12 may comprise multiple foot-locating features. For example, FIG. 3B shows a forefoot member 12A having an additional raised foot-locating feature 44A located proximal to ridge 44. A user can place his or her foot on forefoot member 12 so that the distal aspect of the arch of the user's foot is aligned with the center of raised feature 44A. The ball of the user's foot is thereby located between ridge 44 and raised feature 44A. This can help to ensure proper alignment of the distal metatarsals with respect to the resistance applied to the foot around the ankle, and proper alignment of the phalanges with respect to the resistance applied to the toes around the MTP joints. Additional foot-locating feature 44A may also help to allow forefoot member 12 to conform more closely to the shape of the user's foot, thereby more firmly securing forefoot member 12 to the user's foot. Forefoot member 12 may have additional features as described in WO 2006/094397 which is hereby incorporated herein by reference as if fully set out herein.

Resistance members 16A and 16B (FIG. 4) provide resistance when a user flexes or extends his or her toes, depending on whether the resistance members exert tension in a superior or inferior direction relative to the forefoot member, respectively. These resistance members act on the forefoot member 12 in an area that is primarily distal to ridge 44 (FIG. 4).

Resistance members 16C and 16D (FIG. 4) provide resistance when a user plantar flexes or dorsi flexes his or her ankle, depending on whether the resistance members exert tension in a superior or inferior direction relative to the forefoot member 12, respectively. These resistance members act on the forefoot member in an area that is proximal to ridge 44 (see FIG. 4).

In preferred embodiments, the apparatus is constructed to permit the resistance forces applied to a user's toes around the MTP joints to be different from the resistance forces applied to a user's foot around the ankle. This can be achieved by providing resistance members 16A and 16B with resistance levels different from those provided by resistance members 16C and 16D. For example, resistance members 16A and 16B may have elastic coefficients that are lower than those of resistance members 16C and 16D since the muscles that move a user's foot around the ankle are typically stronger than the muscles that move the user's toes around the MTP joints.

Resistance members 16 may be designed to provide different levels of resistance so that the resistance is roughly matched to the strength of the muscles used to control movements of the toes and ankle. The different levels of resistance may be chosen based on known strength ratios between the various joint movements of the toes and ankle (e.g. the strength ratio of the muscles used to control movements of the toes about the MTP joints the that of the muscles used to control movements of the foot about the ankle joint). For example, resistance members 16A and 16B (which resist certain movements of the toes about the MTP joints) may be designed to provide approximately ⅓ the resistance of resistance members 16C and 16D (which resist certain movements of the foot about the ankle). In some embodiments 'approximately ⅓ means between ¼ and ½. In some embodiments this provides a resistance torque ratio of approximately 1:7 (e.g. a resistance torque ratio in the range of 1:5 to 1:9 in some embodiments). By way of example, where the resistance members are elastic members, the resistance members may comprise elastic members having different elastic coefficients and/or elastic members of different lengths and/or tensions to achieve the desired differences in resistance. Also, resistance members 16 of different resistance levels may be selected to match the toe and ankle strength of a particular user.

The tension of resistance members 16 may be adjusted in a wide range of different ways. For example, the tension may be adjusted by one or more of:

- shortening the tensioner straps with the use of the tension adjusting clips (FIG. 5G) and/or pulling with more force against the handles (FIG. 6*a*), or
- pulling against the handle(s) so as to increase the tension in the elastic members (FIGS. 6A, 6H)
- grasping rigid member 14 or frame 18 and pulling back on it,
- increasing the amount of hip and knee flexion of the opposing limb by pulling against the back of the thigh of the exercising limb or placing pads of various thicknesses between the hands and thigh of that limb or placing padding between the heel of the exercising and non-exercising feet (FIG. 6J);

attaching a handle or handles to a rigid object such as a door frame or table leg (FIG. 6I), or having another person hold handles 17 and moving the user's body further away from the rigid object to exercise opposing movements of the foot and ankle, gripping onto handles that are positioned at different locations relative to the position of the forefoot member, by way of a telescoping system (FIGS. 1C, 1D), pulling or pushing against handles (FIGS. 1C, 1D), depending on the direction of foot/ankle movement, so as to increase the tension in the elastic members, altering the length of the elastic members and securing in place using finger clamps (FIG. 1G).

The exercise apparatus may optionally include a gauge that indicates the tension in some or all of the resistance members. The gauge may be associated with one or more tensioners. Tension gauges (not shown) may be mounted inline with some or all of resistance members 16 to give feedback to the clinician/user on the magnitude of tension generated during specific joint movements. In some embodiments the tension gauges comprise strain gauges and the exercise apparatus includes one or more electronic indicators that display indicia indicating the tension measured by the tension gauges.

A wide range of modifications are possible. Some non-limiting examples of such modifications are set out below. For example, any suitable form of connection may be provided between resistance members 16 and forefoot member 12. For example, grommets, tunnels, or similar attachments may be provided on lateral edges of forefoot member 12 or traversing the underside of forefoot member 12. Resistance members 16 may be sewn, or attached by adhesive to forefoot member 12. Resistance members 16 may be attached to forefoot member 12 by clips, hooks, rivets or screws. Resistance members 16 are optionally detachable from forefoot member 12. In some embodiments, forefoot member 12 is free to slide transversely at least slightly along resistance members 16.

It can be appreciated that exercise apparatus as described herein may provide:

A flexible forefoot bed/support that permits different degrees of resistance for movements about a user's ankle, foot, and toes.

A flexible forefoot bed/support with one or more raised surfaces and/or one or more indentations to receive projecting parts of the foot. The raised surfaces and/or indentations allow for alignment of resistance with anatomical landmarks on the foot.

A multi directional, variable resistance that provides resistance to movements of the foot, toes, and ankle in more than one plane and around more than one axis of rotation.

Apparatus that provides resistance to motions around various joints of the foot, toes and ankle in different amounts, for example in amounts that approximate strength ratios between different joint movements.

Apparatus having features as described herein may be advantageous in various circumstances. For example, apparatus according to some preferred embodiments of the invention provides some or all of the following:

allows the user to exercise the ankle, foot and toes through a full range of all possible ranges of motion. This is important for complete strengthening and flexibility of the associated musculature and joints, respectively.

allows the user to perform combined ankle, foot, and toe movements. This is important for improving coordination of the associated musculature and developing functional strength.

allows the user to perform isolated ankle, foot, and toe movements. This is important for strengthening of specific tissues.

allows for progressive increases in resistance. This is important for proper strengthening of the associated musculature as well as for safety and injury prevention.

allows for eccentric loading of muscle groups that move the foot and/or toes.

allows for balanced strengthening of muscles of the foot and lower leg. This is important for injury prevention and optimal functional performance.

allows for low-impact exercise, which is important for early-stage rehabilitation and for the elderly.

allows for portability and comfortable body positioning.

allows the user to monitor resistance during isolated and combined movements. This is important for strength training and testing.

allows for full range of motion stretching of muscles/tendons associated with movements around the ankle, foot and toes. Stretching is an important adjunct for strength training and rehabilitation.

is easy to use and requires minimal adjustments in body position.

can be used entirely in a seated position, which is important for the elderly or people with limited mobility.

Foot, toe and ankle exercising apparatus as described herein may be used to provide inherent strengthening and stretching of the entire foot muscular system (all 4 layers), along with the ankle tendons and ligaments, and the three groups of muscles of the lower leg, as well as muscles that control movements around the knee and hip.

In other alternative embodiments of the invention resistance members 16 are attached to a user's foot by straps, harnesses or the like in the vicinity of the user's distal metatarsals and/or inter-phalangeal joints. Such embodiments may lack a forefoot support 12, as described above.

As will be apparent to those skilled in the art in the light of the foregoing disclosure, many alterations and modifications are possible in the practice of this invention without departing from the spirit or scope thereof. Features described above in relation to specific embodiments may be combined with features described in relation to other embodiments.

What is claimed is:

1. Exercise apparatus comprising:

a rigid member;

first and second straps connected to the rigid member at points spaced-apart along the rigid member at opposing ends thereof;

first and second handles on the first and second straps respectively;

a forefoot support member configured to be attached to the foot of a user and comprising a transversely-extending foot-locating feature projecting on a superior surface thereof;

first and second pairs of flexible resistance members coupled between the forefoot support member and the rigid member, the first pair of flexible resistance members coupled between corresponding first locations on the forefoot member that are in front of the foot-locating feature and corresponding first locations spaced-apart from one another on the rigid member, the second pair of resistance members coupled between corresponding second locations on the forefoot member that are behind the foot-locating feature and corresponding second locations spaced-apart from one another on the rigid member;

wherein the forefoot member is flexible about a substantially transverse axis located between the first locations on the forefoot member and the second locations on the forefoot member.

2. Exercise apparatus according to claim 1 wherein the first and second straps are adjustable in length.

3. Exercise apparatus according to claim 1 wherein the rigid member is flattened on one side.

4. Exercise apparatus according to claim 1 wherein the resistance members comprise elastic members and the first pair of flexible resistance members has a lower elastic coefficient than the second pair of flexible resistance members.

5. Exercise apparatus according to claim 4 wherein first pair of flexible resistance members provides a resistance to stretching that is in the range of ¼ to ½ of a resistance to stretching provided by the second pair of flexible resistance members.

6. Exercise apparatus according to claim 4 wherein first pair of flexible resistance members provides a resistance to stretching that is approximately ⅓ of a resistance to stretching provided by the second pair of flexible resistance members.

7. Exercise apparatus according to claim 1 wherein the resistance members are coupled to the forefoot support member by removable clips.

8. Exercise apparatus according to claim 1 wherein the rigid member is extendable between a shortened configuration and an elongated configuration.

9. Exercise apparatus according to claim 1 wherein, when the resistance members are under tension, the resistance members form an angle of approximately 45 degrees with a longitudinal centerline of the rigid member.

10. Exercise apparatus according to claim 1 comprising a set of interchangeable resistance members, the set of interchangeable resistance members having resistance members of each of a plurality of different elastic coefficients.

11. Exercise apparatus comprising:

a forefoot member attachable to a forefoot of a user;

a plurality of resistance members connected to the forefoot member, the resistance members resisting motion of the forefoot member, wherein:

the forefoot member is selectively positionable in a first position wherein the resistance members extend in a superior direction from the forefoot member and resist motion of the forefoot member in an inferior direction and a second position wherein the resistance members extend in an inferior direction from the forefoot member and resist motion of the forefoot member in a superior direction;

the forefoot member comprises a transversely-extending ridge on the superior surface of the forefoot member over which a user can place the user's toes; and the resistance members include resistance members attached to the forefoot member in front of the ridge and other resistance members attached to the forefoot member behind the ridge.

12. Exercise apparatus according to claim 11 wherein the resistance members attached to the forefoot member in front of the transversely extending ridge provide a different level of resistance compared to those resistance members attached to the forefoot member behind the ridge.

13. Exercise apparatus according to claim 11 wherein a distal aspect of the forefoot member is flexible about multiple transverse axes.

14. Exercise apparatus according to claim 13 wherein the forefoot member is relatively inflexible in torsion.

15. Exercise apparatus according to claim 11 wherein the resistance members comprise elastic members.

16. Exercise apparatus according to claim 11 wherein:

the forefoot member comprises substantially inelastic projections extending laterally on either side of the forefoot member, a central part of each of the projections is located either to the front or rear of the transversely extending ridge, and, the resistance members are each connected to a corresponding one of the projections.

17. Exercise apparatus according to claim 16 wherein the projections are tapered.

18. Exercise apparatus according to claim 11 wherein the elastic members are coupled to a rigid member at points such that the elastic members make an angle of approximately 90 degrees to one another at the forefoot member.

19. Exercise apparatus according to claim 18 comprising a tensioning system attached to the rigid member, the tensioning system comprising one or more handles connected to the rigid member by an adjustable-length flexible element.

20. Exercise apparatus according to claim 19 wherein the one or more handles are securely attachable to a fixed object to allow the user to perform movements in an opposing directions.

21. Exercise apparatus according to claim 11 wherein the rigid member is attached to a frame comprising handles supported on telescoping members wherein resistance offered by the elastic members is adjustable by adjusting lengths of the telescoping members.

22. Exercise apparatus according to claim 21 wherein the rigid member is curved and the forefoot member is positionable to permit the resistance members to exert tension in either a superior or an inferior direction relative to the forefoot member to allow for opposing movements of the foot and ankle.

* * * * *